US008307536B2

(12) United States Patent
Debray et al.

(10) Patent No.: US 8,307,536 B2
(45) Date of Patent: Nov. 13, 2012

(54) COIL CAPABLE OF GENERATING A MAGNETIC FIELD AND METHOD OF MANUFACTURING SAID COIL

(75) Inventors: Francois Debray, Proveyzieux (FR); Rolf Pfister, Voreppe (FR); Jean Dumas, Varces (FR); Christophe Trophime, Saint Martin le Vinoux (FR); Nadine Vidal, Hurtieres (FR); Jean-Marc Tudela, Seyssinet (FR)

(73) Assignee: Centre National de la Recherché Scientifique (CNRS), Paris (FR)

( * ) Notice: Subject to any disclaimer, the term of this patent is extended or adjusted under 35 U.S.C. 154(b) by 82 days.

(21) Appl. No.: 12/766,715

(22) Filed: Apr. 23, 2010

(65) Prior Publication Data

US 2010/0271165 A1 Oct. 28, 2010

Related U.S. Application Data

(63) Continuation-in-part of application No. PCT/EP2008/064338, filed on Oct. 23, 2008.

(51) Int. Cl.
*H01F 7/06* (2006.01)
*H01F 27/28* (2006.01)

(52) U.S. Cl. ..... 29/602.1; 336/222; 336/223

(58) Field of Classification Search ..... 336/196, 336/199, 208, 222, 223, 128; 29/602.1, 173
See application file for complete search history.

(56) References Cited

U.S. PATENT DOCUMENTS

| | | | | |
|---|---|---|---|---|
| 2,007,484 | A * | 7/1935 | Tolerton | 381/407 |
| 2,592,802 | A | 4/1952 | Harrold | |
| 3,427,710 | A | 2/1969 | Williams | |
| 3,466,743 | A * | 9/1969 | De Puy | 29/602.1 |

FOREIGN PATENT DOCUMENTS

| | | | |
|---|---|---|---|
| EP | 0 146 494 | A1 | 6/1985 |
| EP | 0146494 | A1 * | 6/1985 |
| FR | 2892524 | | 4/2007 |
| WO | WO 2009/053420 | A1 | 4/2009 |

OTHER PUBLICATIONS

Trophime, C. et al., "Magnetic Calculations at the Grenoble High Magnetic Field Laboratory," *IEEE Transactions on Applied Superconductivity*, vol. 12, No. 1, Mar. 2002, pp. 1483-1487.

(Continued)

*Primary Examiner* — Mohamad Musleh
*Assistant Examiner* — Mangtin Lian
(74) *Attorney, Agent, or Firm* — Blakely, Sokoloff, Taylor & Zafman

(57) ABSTRACT

A method for manufacturing a coil capable of generating a magnetic field known as an intense field when an electric current passes through it. There is formed at least one boss on at least one turn of the coil and at least one recess of a corresponding form in an adjacent turn, such that the boss extends perpendicularly to the recess for absorbing the mechanical stresses caused by the electromagnetic forces and mechanical forces of thermal origin. The coil is capable of generating a magnetic field known as an intense field when an electric current passes through it. The coil includes a tube made of a conductive material and cut out along an overall helicoidal cut-out line. At least one turn of the coil includes at least one boss extending perpendicularly to a recess of a corresponding form in an adjacent turn.

11 Claims, 6 Drawing Sheets

OTHER PUBLICATIONS

A. Bourquard et al., A New Design for the Superconducting Outsert of the GHMFL 42+ T Hybrid Magnet Project, IEEE Transactions on Applied Superconductivity 20, 684 (2010).

A. Bourquard et al., The 42+T Hybrid Magnet Project at CNRS-LNCMI-Grenoble, Journal of Low Temperature Physics 159, 9th International Conference on Research in High Magnetic fields, Jul. 22-25, 2009, Dresden, Germany.

L. Latrasse et al., Seism: A 60 GHz cusp electron cyclotron resonance ion source, Review of Scientific Instruments 81 02A324 (2010), 13th International Conference on Ion Sources, Sep. 22-25, 2009, Gatlinburg, Tennessee.

* cited by examiner

COIL CAPABLE OF GENERATING A MAGNETIC FIELD AND METHOD OF MANUFACTURING SAID COIL

This is a Continuation-in-Part application of International Application Number PCT/EP2008/064338, filed Oct. 23, 2008.

FIELD OF THE INVENTION

The present invention relates to a coil capable of generating a magnetic field adapted in particular for generating intense magnetic fields and/or for performance under large mechanical stresses, and a method for manufacturing said coil.

BACKGROUND OF THE INVENTION

In the field of magnetic field production, it is well known to generate an intense magnetic field by "magnets" constituted by one or more coils through which an intense electric current passes, said coils being cooled.

Said coils are generally constituted by cylindrical tubes made of conductive or superconducting material and cut out along an overall helicoidal cut-out line, at constant pitch or not, to form turns.

These coils for intense fields are currently almost exclusively used in intense magnetic field laboratories and could be of use for example in NMR machines, as per the acronym "Nuclear Magnetic Resonance" for the imaging via magnetic resonance.

These NMR machines usually have a structure of the tunnel type with a central space reserved for the patient and an annular structure which integrates both means for creating in the central observation space a homogeneous and intense main magnetic field, and radiofrequency excitation means and radiofrequency processing means for signals reemitted by the body of the patient placed in the central observation space, in response to the excitation sequences. To differentiate the radiofrequency signals sent in response and create an image, these machines also comprise coils known as gradient coils to superpose on the intense homogeneous field additional magnetic fields, the value of which depends on the spatial coordinates of their place of application.

Such an NMR machine is described for example in French patent application FR 2 892 524.

Gradient coils of magnetic fields or those generating an intense magnetic field are subjected to intense electromagnetic forces which cause mechanical stresses leading to deformation of the turns of the coil. Deformation of the turns can cause a lack of reliability of the machine and/or non-homogeneity of the magnetic field detrimental to high-quality imaging production.

Documents U.S. Pat. No. 2,592,802, EP 0 146 494 and U.S. Pat. No. 3,466,743 which describe induction coils are also known.

Document U.S. Pat. No. 2,592,802 describes an induction coil comprising a tube made from conductive material and cut out along several overall helicoidal cut-out lines to form turns which are separated by a vertical portion ensuring separation between the turns. Said separation portion is cut out to form a pair of spacing members on either side of a cylindrical hole in which is advantageously inserted a rod made of insulating material.

Document EP 0 146 494 describes an induction coil comprising incomplete annular cut-outs made in a cylindrical tube, said incomplete annular cut-outs being connected by two vertical cut-outs. This type of induction coil is intended to displace spacers in nuclear reactors and is not intended to receive high-intensity currents to form intense fields.

Document U.S. Pat. No. 3,466,743 describes a coil comprising a tube made of conductive material and cut out along an overall helicoidal cut-out line to form turns, said turns passing through holes initially made along the tube, the cut-out line being filled with insulating material to prevent any deformation when very high-intensity currents pass through the coil.

None of the coils described in these documents is intended to form fields known as intense fields and does not absorb stresses caused by electromagnetic forces on the turns of the coils.

SUMMARY OF THE INVENTION

One of the aims of the invention is therefore to rectify all these disadvantages by proposing a coil or a set of coils capable of generating a magnetic field and particularly capable of generating an intense magnetic field, and a method for manufacturing such coil of simple design, which is straightforward and absorbs stresses caused by electromagnetic forces on the turns of the coils.

To this end and according to the invention, is proposed a method for manufacturing a coil capable of generating a magnetic field known as intense field when an electric current passes through it, comprising a formation step of turns in a cylindrical tube, characterised in that it comprises at least one formation step of at least one boss on at least one turn of said coil and of at least one recess of a corresponding form in an adjacent turn, such that the boss extends perpendicularly to said recess, for absorbing the mechanical stresses caused by the electromagnetic forces and the mechanical forces of thermal origin.

According to an essential characteristic of the process according to the invention, the latter comprises a prior optimisation step of the boss or bosses and of the recess or recesses.

This optimisation step comprises at least the following steps of:

- geometric modelling of the tubes and cut-outs defining the turns,
- determining a meshing of the turns and of the boss or bosses and of the corresponding recess or recesses from the preceding geometric model,
- simulating temperature rises and/or electromagnetic fields and/or mechanical behaviour from the meshing,
- comparison of the temperature rises and/or electromagnetic fields and/or mechanical deformations with those of a model known as reference model comprising no bosses.

In addition, the successive bosses on a given turn can be advantageously spaced angularly to optimise absorbing electromagnetic stresses and prevent excessive deformations of turns.

Said bosses are formed such that the concavity of each boss has the same orientation.

According to a variant embodiment, the bosses are formed such that the concavity of at least one boss has an orientation opposite the orientation of the concavity of at least one second boss.

The turns, the bosses and the corresponding recesses are formed by cutting out a cylindrical tube along an overall helicoidal cut-out line.

In addition, the width of each turn is constant or variable.

Besides, insulating material can be deposited in the cut-out line between two consecutive turns.

Another object of the invention relates to a coil or a set of coils capable of generating a magnetic field known as intense field when an electric current is passed through, said coil comprising at least one tube or a set of tubes made of conductive and/or superconducting material and cut out along an overall helicoidal cut-out line, characterised in that at least one turn of the coil comprises at least one boss extending perpendicularly to a recess formed in an adjacent turn absorbing the mechanical stresses caused by the electromagnetic torque on the turns.

Advantageously, the successive bosses on a turn are angularly offset to optimise absorbing electromagnetic stresses and prevent excessive deformations of turns.

Said coil comprises a plurality of bosses and recesses whereof the concavity is oriented in the same direction.

According to a variant embodiment, said coil comprises a plurality of bosses and recesses and the concavity of at least one boss has an orientation opposite the orientation of the concavity of at least one second boss.

Each boss has for example a general semicircular or triangular or square or rectangular form.

In addition, the width of each turn is constant or variable.

Besides, said coil comprises insulating material covering the cut-out line.

Said coil is made either of a cylindrical tube of electrically conductive materials or of superconducting material.

BRIEF DESCRIPTION OF THE DRAWINGS

Other advantages and characteristics will emerge from the following description of several variant embodiments, given by way of non-limiting examples, a coil capable of generating a magnetic field and particularly capable of generating an intense magnetic field and a method for manufacturing the coil according to the invention, from the attached drawings, in which.

DETAILED DESCRIPTION OF THE INVENTION

Figure 1:
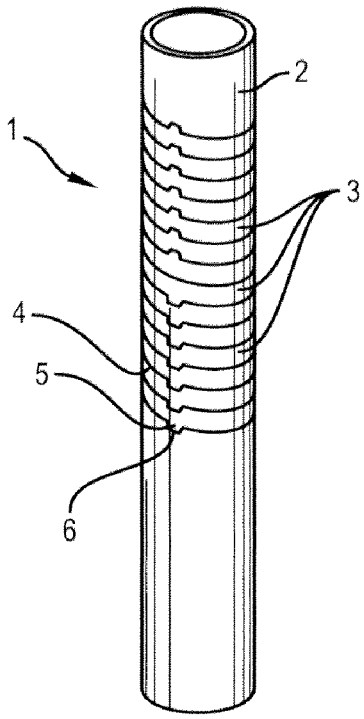
FIG. 1 is a perspective view of a coil according to the invention.

In reference to FIG. 1, the coil 1 comprises an overall cylindrical tube 2 in which turns 3 have been formed using any appropriate cutting means along a helicoidal cut-out line 4, said tube 2 being made of electrically conductive material such as copper or a bulk superconducting for example, and said coil optionally comprising insulating material covering the cut-out line 4 in a way known to the person skilled in the art.

The tube 2 provided with turns 3 can constitute the coil 1 as such. However, according to another embodiment, the tube with the turns constitutes a support for a winding, this "support+winding" assembly forming said coil. In the case of a superconducting magnet, the winding can for example be formed by a superconducting band or wire (for example comprising an alloy of type NbTi, Nb3Sn, Nb3Al, or YBaCuO) surrounding the tube cut out in a spiral. Therefore the tube serves as mechanical support for the band or wire and is also used in thermal regulation of the superconducting magnet. In another variant, the superconducting band or wire is fixed supported on the internal face of the tube cut out in a helix. Further, the coil can be made of a plurality of tubes 2.

The helicoidal cut-out 4 is made as per parametric equations in an orthonormal Cartesian system where the axis Oz coincides with the axis of revolution of the tube 2:

$x=R*\cos(t)$, $y=R*\sin(t)$, $z=k*t$ where k designates a given strictly positive constant. R and t correspond to the cylindrical coordinates in a plane OxOy.

A plurality of turns 3 of the coil 1 comprises a boss 5 extending perpendicularly to a recess 6 of a corresponding form formed in an adjacent turn 3 for absorbing the mechanical stresses caused by electromagnetic torque on the turns 3 when a current of strong intensity passes through them.

In this particular embodiment all the bosses 5 and the recesses 6 of the turns 3 are overall aligned along a longitudinal straight line.

Yet, it is apparent that the bosses 5 of two adjacent turns could be angularly offset.

The upper part of the coil 1, arbitrarily illustrated vertically in FIG. 1, comprises a plurality of bosses 5 and recesses 6 whereof the concavity is oriented in the same direction, towards the lower end of said coil 1.

In addition, the lower part of the coil 1 also comprises a plurality of bosses 5 and recesses 6 whereof the concavity is oriented in the same direction, for example towards the upper end of said coil 1, opposite the direction to orientation of the concavity of the bosses 5 of the turns 3 of the upper part of said coil.

It is understood that the coil 1 could comprise only a single boss and a single recess or a plurality of bosses and recesses on one or more turns, the concavity of at least one boss oriented opposite the orientation of the concavity of at least one second boss, without as such departing from the scope of the invention.

In this embodiment, each boss 5, and consequently each recess 6, has general semicircular form, but it is apparent that each boss 5 could have any form such as a triangular, square or rectangular form, for example.

In addition, in this particular embodiment, the width of each turn 3 is constant, but the width of any or part of the turns could vary, the width of the space separating two adjacent turns being constant, including at the level of the bosses 5 and recess 6.

Further, the coil could comprise a plurality of tubes 2 without as such departing from the scope of the invention.

Figure 2:
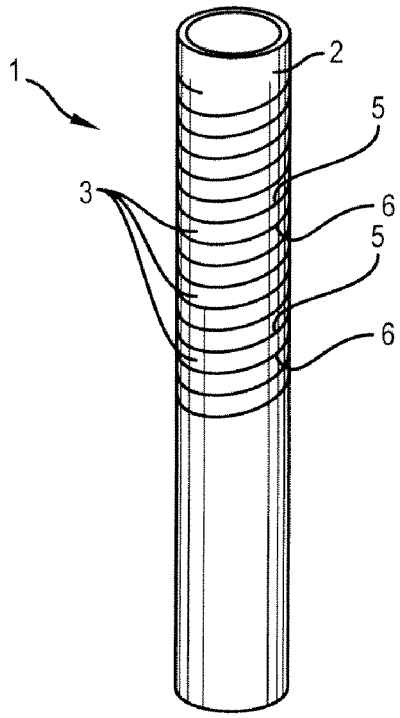
FIG. 2 is a perspective view of a variant embodiment of the coil according to the invention.

According to a variant embodiment of the coil according to the invention, in reference to FIG. 2, the latter comprises as previously an overall cylindrical tube 2 in which turns 3 were formed by cutting out along a helicoidal cut-out line 4.

The helicoidal cut-out 4 is obtained as per the parametric equations in an orthonormal system where the axis Oz coincides with the axis of revolution of the tube 2:

x=R*cos(f(t)), y=R*sin(f(t)), z=k*g(t) where R and k are strictly positive given constants.

It is evident that f(t) could be substituted by f(t,θ) to adjust the angle of cut-out along Oz in a radial plane. The bosses 5 and the recesses 6 would then have an overall conical form, that is, their edges would not be perpendicular to the axis of revolution of the tube 2.

The function g(t) is preferably a trigonometric function of form, for example: x=R*cos(t), y=R*sin(t)

$$z=t/(2*\pi)*(1+a*\cos(4t))$$

Thus, the helicoidal cut-out 4 forms bosses 5 and recesses 6 in the turns 3 relative to a helicoidal cut-out of reference obtained according to the parametric equations:

x=R*cos(t), y=R*sin(t), z=k*t where k is a strictly positive given constant.

Here in the text, by boss is meant a projecting part of a turn 3 relative to a turn made by a helicoidal cut-out reference line.

Figure 3:
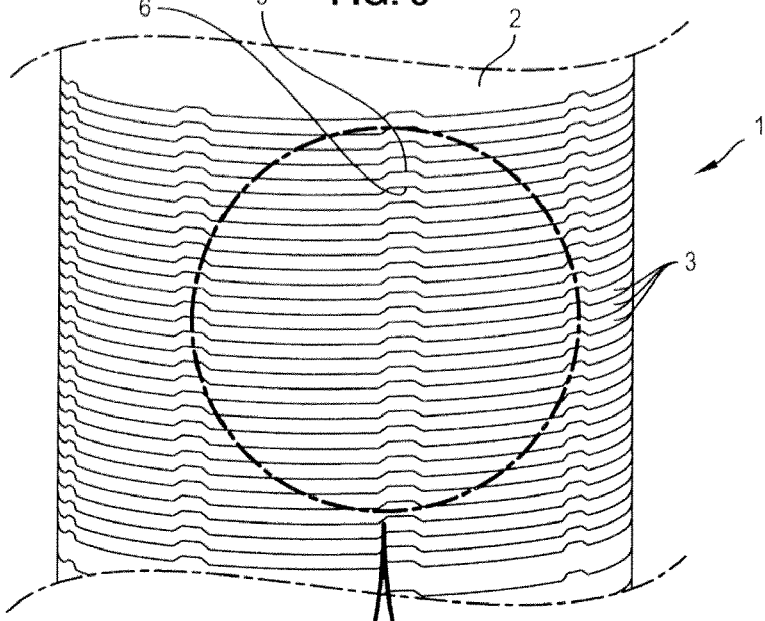
FIG. 3 is a perspective partial view of a coil according to the invention.

According to another variant embodiment of the coil of the invention, in reference to FIG. 3, the latter comprises, as before, an overall cylindrical tube 2 in which turns 3 have been formed by cutting out along an overall helicoidal cut-out line 4, said turns comprising bosses 5 and recesses 6 of corresponding forms. Said bosses 5 and said recesses 6 have a trapezoid form.

The cross-section of the bosses 5 and recesses 6 can decrease from the outer wall towards the inner wall of the tube 3.

This form of bosses and of recesses is particularly adapted for employing thin turns and/or for insulating wedging.

Also, it is apparent that this technique can be applied to the design of coils of non-uniform current density.

Figure 4:
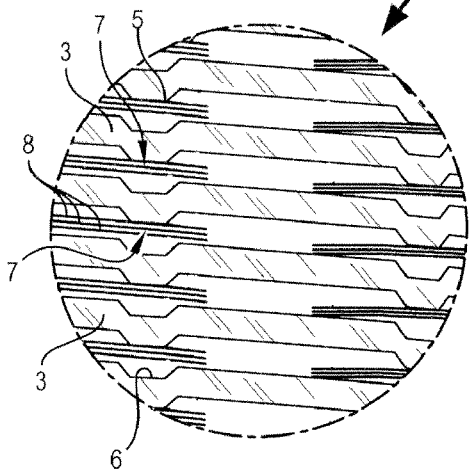
FIG. 4 is a perspective view of a detail of the coil according to the invention illustrated in FIG. 3 prior to compression of the insulating plates.
Figure 5:
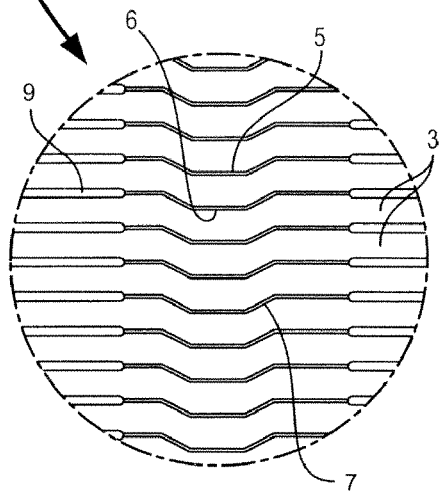
FIG. 5 is a perspective view of a detail of the coil according to the invention illustrated in FIG. 3 following compression of the insulating plates.

In addition, in reference to FIG. 4, insulating plates such as pre-impregnated fibreglass plates known as "pre-preg", according to the English acronym "pre-impregnated"; said plates having a form with an annular cross-section can be positioned between two adjacent turns 3. To enable introduction of these insulating plates 7, the turns 3 are spread by any appropriate means (FIG. 4). These insulating plates 7 advantageously comprise at least 3 thin superposed insulating sheets 8. In this way, once the insulation is compressed, in reference to FIG. 5, it conforms to the outline of the turn 3 without breaking. In fact, such superposition of thin insulating sheets 8 causes a decrease of the internal stress of the insulator. In addition, the intermediate sheet 8 is never in direct contact with the metal or the superconducting material of the turns 3, ensuring an increased electrical safety.

It is apparent that the insulating plates 7 could comprise any number of sheets 8 and that they could be made of any insulating material without as such departing from the scope of the invention.

It is further to be noticed that wedging of insulating plates between successive bosses 5 and recesses 6 enables passage of cooling liquid at the level of said bosses 5 and said recesses 6 (FIG. 5), the coil 2 which comprises no insulation at the level of the bosses 5 and the recesses 6 comprising openings 9 for circulation of liquid or cooling fluid between the interior and the exterior of the tube and vice versa. Said cooling liquid comprises for example water in the case of resistive magnets, or helium or liquid nitrogen in the case of superconducting materials.

Figure 7:
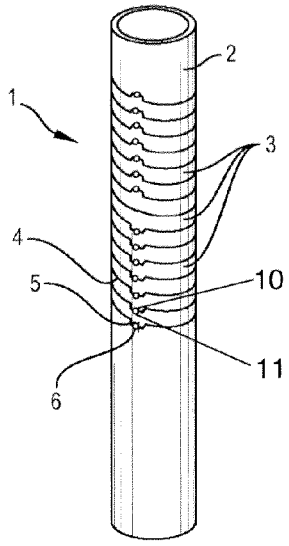
FIG. 7 is a perspective view of another variant embodiment of the coil according to the invention.

According to a preferred embodiment of the invention such as illustrated in FIG. 7, the corresponding recesses 6 and bosses 5 present a profile which cooperates to form a channel for additional circulation of cooling liquid or fluid between the interior and the exterior of the tube and inversely.

More precisely, an indentation (10,11) is provided in the edge of two adjacent turns at the portions forming the boss 5 and the recess 6 respectively. Each indentation 10 is formed in the profile in the form of a boss 5 of a turn 3 so as to be facing the indentation 11 made in the profile in the form of a recess 6 of the adjacent turn 3. In this way, when such a boss 5 faces the corresponding recess 6, the indentations (10,11) made in these elements form a passage or channel between the interior and the exterior of the tube.

The resulting passage between the interior and the exterior of the tube allows cooling fluid to circulate through the coil, such as for example water or cryogenic fluid (e.g. fluid comprising nitrogen, helium or hydrogen). This accordingly enables permanent cooling of the structure, in both case where the tube serves as a support for a winding to form the coil and where it constitutes the coil as such. Such a cooling possibility is particularly advantageous to ensure the thermal transfers necessary to compensate for any thermal increase undergone by a superconducting coil in the event of a quench, the quench corresponding to the transition from the superconducting state to the resistive state. Being able to thermally regulate the coil by circulation of cooling fluid between the interior and the exterior of the tube is also particularly advantageous for reducing mechanical deformations of thermal origin. This is why such a configuration of the coil is particularly well adapted for use as superconducting magnet.

Such an arrangement of boss 5 and recess 6 associated with the indentations (10,11) in each of the turns 3 is therefore highly advantageous for compensating both for mechanical deformations of thermal origin and also those due to electromagnetic forces.

In addition, placing the indentations (10,11) at the level of the bosses 5 and recesses 6 has the advantage of allowing machining of said indentations (10,11) concomitantly with the corresponding bosses 5 and recesses 6, so that the properties of the coil are greatly improved without complicating its manufacturing process.

The indentations (10,11) made in the edges of each of the turns can take any form, for example semicircular, triangular, square, rectangular, trapezoid, or any other form that enables creation of a passage for cooling fluid when an indentation and the additional indentation are opposite. It should be noted that the form and the size of the indentation or indentations will be optimised to allow passage of the cooling fluid and to control its flow rate while ensuring the physical properties (especially mechanical and electrical) of the turns (for example given the minimal width of the turns).

Figure 8:
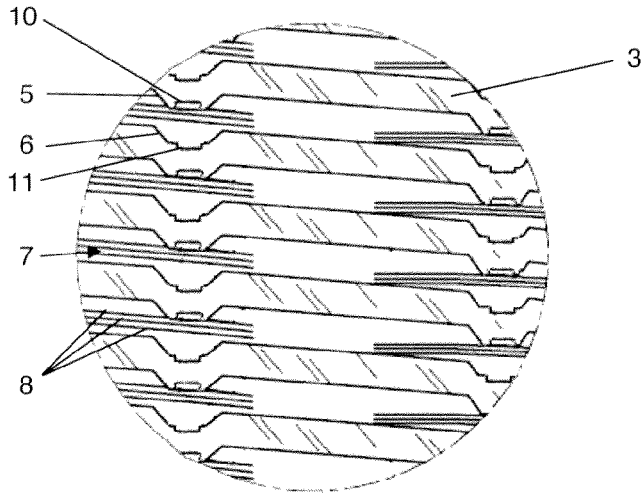
FIG. 8 is a perspective view of a detail of the coil according to yet another variant embodiment, prior to compression of the insulating plates.
Figure 9:
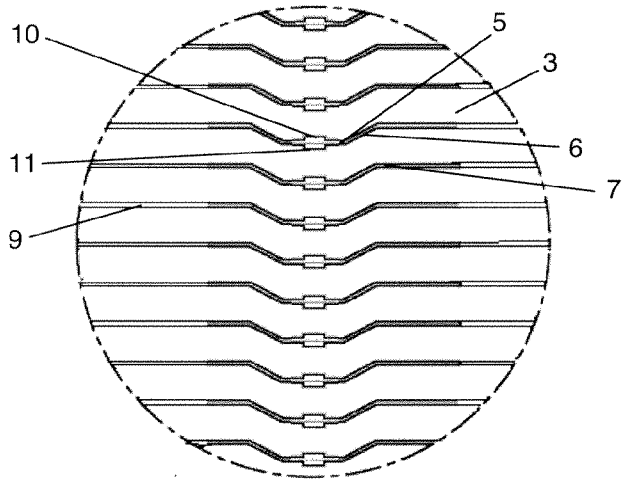
FIG. 9 is a perspective view of a detail of the coil of FIG. 8, following compression of the insulating plates.
Figure 11:
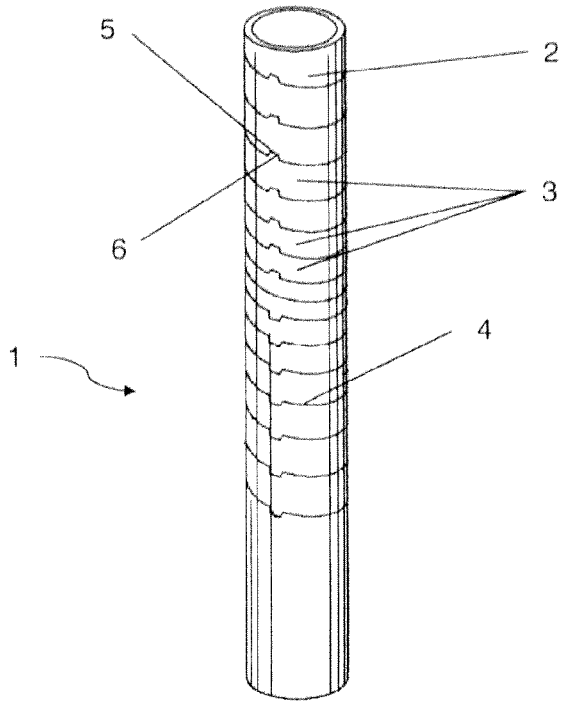
FIG. 11 is a perspective view of another variant of the coil similar to FIG. 7 excepting that the turns 3 are shown having different spacing between each turn.

In the event where insulating plates 8 are positioned between a boss 5 and the corresponding recess 6, as illustrated in FIGS. 8 and 9, positioning the indentation or indentations (10,11) made at the portions forming the bosses 5 and recesses 6 in the zone comprising the insulating plates 8 is particularly advantageous, since the opening made by these indentations ensures thermal transfer in this zone, which zone would otherwise forms a hot point in the coil which is to be avoided so as to have even thermal regulation. The insulating material actually forms a barrier preventing circulation of any cooling fluid between two adjacent turns, which causes local heating present in normal operation of the resistive magnets, but also in the event of quench for a superconductor. When at least one of the turns 3 opposite the insulating material has an indentation 10 at the level of its edge, such an indentation forms an opening which will enable the required thermal transfer.

Figure 10:
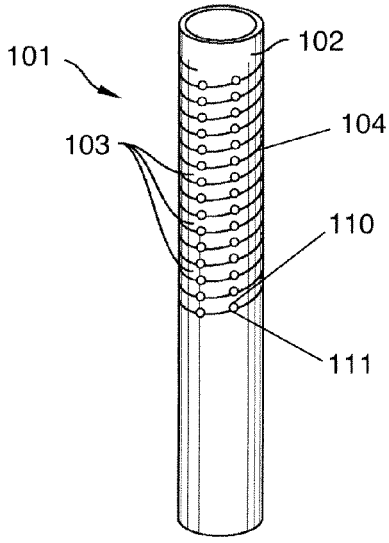
FIG. 10 is a perspective view of another embodiment of the coil.

Even if the association of the indentations with the configuration of turns having bosses and recesses is particularly advantageous due to the combined effect resulting from this specific association, a coil 101 such as illustrated in FIG. 10 can also be provided, in particular for forming a superconducting magnet, said coil comprising a tube 102 comprising a plurality of turns 103 formed by a cut-out according to a preferably helicoidal cut-out line 104, in which a plurality of turns 103 of the coil 101 comprises an indentation 110 facing an additional indentation 111 formed in an adjacent turn 103, such that these indentations (110, 111) form an opening, that is, a passage or channel, between the interior and the exterior of the tube 102. Such a passage between the interior and the exterior of the tube helps circulate cooling fluid across the coil, such as for example cryogenic fluid (e.g. fluid based on nitrogen, helium or hydrogen). Such a cooling possibility is particularly advantageous for compensating for any thermal increase undergone by the coil in case of quench. Being able to thermally regulate the coil by passage of cooling fluid between the interior and the exterior of the tube is further particularly advantageous for reducing mechanical deformations which can be of thermal origin.

Forming two opposite indentations in two adjacent turns to form a passage through the tube is particularly preferred when the width of the turns has to remain minimal, which effectively distributes the size of the opening over two adjacent turns, and thus prevents excessive embrittlement of the turns at the level of the indentations. In this case, the indentations made in several adjacent turns can advantageously have an angular offset. But it is also possible to make only one indentation in the edge of a turn, without forming in the adjacent edge an additional indentation facing the first one, especially in the case where the dimensions of the turns permits such an arrangement.

Figure 6:
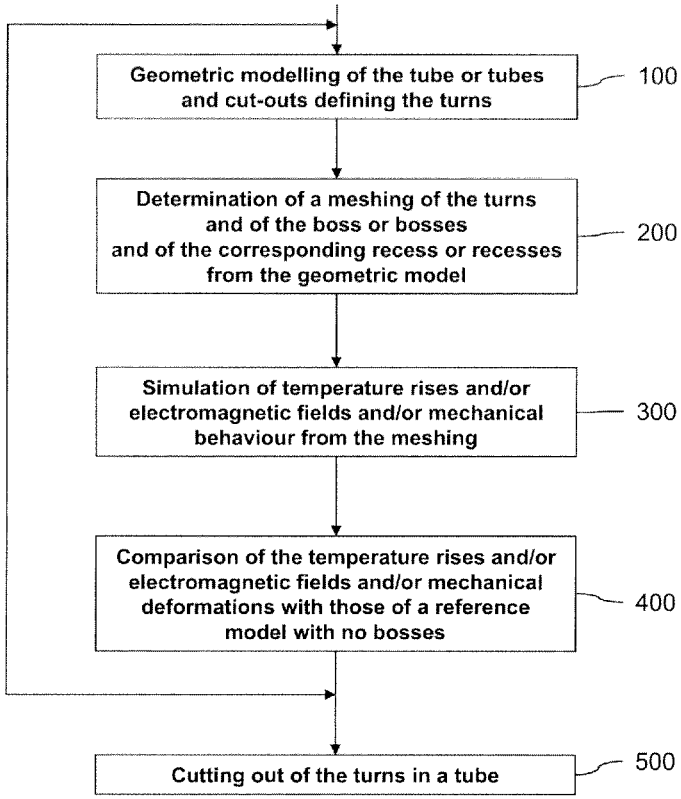
FIG. 6 is a diagram illustrating the steps for making a coil according to the invention.

The method for manufacturing a coil according to the invention will now be explained, in reference to FIG. 6.

In an initial step 100, a geometric model of the turns is made using computer-aided design software (CAD) such as CATIA® or Open Cascade marketed by the company Open Cascade SAS. Meshing of the turns 3 and of the boss or bosses 5 and of the corresponding recess or recesses 6 is carried out in a step 200 by the CAD model using adapted software such as for example CATIA® software or a Ghs3d® mesher by the company Distene, then in a step 300, simulation of temperature rises and/or electromagnetic fields and/or of the mechanical behaviour corresponding to previous meshing is carried out.

Said temperature rises and/or electromagnetic fields and/or mechanical deformations produced by this meshing are compared, in a step 400, to a reference model having neither bosses nor recesses. If needed, modifications can be made to the geometry of the turns. The procedure is then repeated to obtain an adapted model.

The same procedure can be utilised for optimisation of mechanical stresses.

Steps 100 to 400 are reiterated to obtain a meshing having a minimal temperature rise and/or a homogeneous or quasi-homogeneous magnetic field and/or a minimisation of displacements due to electromagnetic and thermal loads.

The different optimisation steps presented hereinabove can also include as extra parameter the characteristics of the indentations favouring thermal transfers via the tube.

The parameterized curve corresponding to the retained cut-out determined in this way is then transmitted to a digital cutting machine which proceeds with cutting out the turns 3, bosses 5 and recesses 6 in the tube 2, in a step 500.

It is apparent that prior to the meshing step 100 a step for determining the number of turns, the width of the turns and the dimensions of the tube including its length, its thickness and its external diameter is conducted in keeping with the idea of the publication "Magnet Calculations at the Grenoble High Magnetic Field Laboratory", Christophe Trophime, Konstantin Egorov, Francois Debray, Walter Joss and Guy Aubert, IEEE TRANSACTIONS ON APPLIED SUPERCONDUCTIVITY. VOL. 12, NO 1, MARCH 2002.

In addition, it is apparent that the bosses 5 and the recesses 6 cooperate to ensure centering of the turns.

It is understood that the tube 2 could comprise a set of tubes, said tube 2 or the set of tubes being made of conductive material and/or bulk superconducting material. Alternatively, the tube 2 could constitute a supporting tube made of copper or stainless steel for example, and to which superconducting wire or cables are connected, such as by soldering. The supporting tube fitted with bosses 5 and recesses 6 according to the invention then enables absorbing electromagnetic forces and as thermal dissipation in the event of "quench", that is the accidental or not return to normal state of the superconducting part.

Finally, it is apparent that the coils described hereinabove could have numerous applications in the fields of magnetic field generation for experimental purposes, or nuclear magnetic resonance imaging for example, and that the above examples are only particular illustrations are in no way limiting as to fields of application of the invention.

We claim:

1. A method for manufacturing a coil capable of generating a magnetic field known as intense field when an electric current passes through said coil, comprising:

forming turns by cutting a cylindrical tube along an overall helicoidal cutting line, wherein said cutting line is made to form at least one boss on at least one turn of said coil and at least one recess of corresponding form in an adjacent turn such that the boss extends perpendicularly to said recess, said boss and corresponding recess being formed for absorbing the mechanical stresses caused by the electromagnetic forces and the mechanical forces of thermal origin;

wherein the method further comprises a prior optimization step of the boss or bosses and of the recess or recesses said optimization step comprising the following steps:

determining a meshing of the turns and the boss or bosses and the corresponding recess or recesses, simulating at least one of a temperature rise and electromagnetic fields from the meshing, comparing at least one of the temperature rise and the electromagnetic fields with those of a reference meshing having no bosses, comparing the displacements under the electromagnetic and thermal loads of the turns with those of a reference model having no bosses.

2. The method of claim 1, wherein the bosses of two adjacent turns are spaced angularly.

3. The method of claim 1, wherein the bosses are formed such that a concavity of each boss has the same orientation.

4. The method of claim 1, wherein the bosses are formed such that a concavity of at least one boss has an orientation opposite the orientation of a concavity of at least one second boss.

5. The method of claim 1, wherein the width of each turn is constant.

6. The method of claim 1, wherein the width of each turn is variable.

7. The method of claim 1, wherein insulating material is deposited in the cut-out line between two consecutive turns.

8. The method of claim 1, further comprising at least one step of formation of at least one indentation in an edge of at least one turn of said coil, said indentation forming a passage between the interior and the exterior of the tube.

9. The method of claim 8, wherein the formation step of at least one indentation comprises formation of at least a first indentation on an edge of at least one turn of said coil and of at least a second indentation in an edge of an adjacent turn such that the first indentation faces the second indentation, the first and second indentations made in the adjacent turns forming a passage between the interior and the exterior of the tube.

10. The method of claim 9, wherein the first indentation is formed in the edge of the turn at the portion forming a boss and the second indentation is formed in the edge of the turn at the portion forming a recess.

11. The method of claim 10, wherein formation of the boss and of the first indentation is done concomitantly, and in that formation of the recess and of the second indentation is done concomitantly.

* * * * *